United States Patent [19]

Daniels

[11] Patent Number: 5,046,271

[45] Date of Patent: Sep. 10, 1991

[54] POWERED SNOW PLOW FOR ATTACHMENT TO REAR OF VEHICLE

[76] Inventor: Gregory J. Daniels, 15N365 Old Sutton Rd., East Dundee, Ill. 60118

[21] Appl. No.: 503,152

[22] Filed: Apr. 2, 1990

[51] Int. Cl.[5] ..... E01H 5/06

[52] U.S. Cl. ..... 37/231; 37/236; 37/268

[58] Field of Search ..... 37/231, 234, 235, 236, 37/268, 269

[56] References Cited

U.S. PATENT DOCUMENTS

| | | | |
|---|---|---|---|
| 1,161,275 | 11/1915 | Wood | 37/268 |
| 2,552,425 | 5/1951 | Hedley | 37/219 X |
| 3,640,005 | 2/1972 | Chiarolanza et al. | 37/234 |
| 4,320,589 | 3/1982 | Pelazza | 37/236 |
| 4,506,465 | 3/1985 | Johnson | 37/268 |
| 4,907,357 | 3/1990 | Lilienthal | 37/268 X |

FOREIGN PATENT DOCUMENTS

| | | | |
|---|---|---|---|
| 1017561 | 9/1977 | Canada | 37/234 |
| 24499 | 2/1951 | Finland | 37/236 |

*Primary Examiner*—Dennis L. Taylor
*Assistant Examiner*—Arlen L. Olsen
*Attorney, Agent, or Firm*—Charles F. Meroni, Jr.

[57] ABSTRACT

A vehicle rear mounted snow plow apparatus for plowing within a foot of a permanent structure, including a vehicle supported snow plow actuating mechanism for raising and lowering the snow plow, and linkage for tilting the snow plow to remove snow or to position the plow to push snow in front of the plow. A hydraulic system for moving the actuating mechanism up or down. A pair of stabilizing and pivoting arms to pull said plow in the plowing position and to partially support the snow plow while traveling.

9 Claims, 4 Drawing Sheets

POWERED SNOW PLOW FOR ATTACHMENT TO REAR OF VEHICLE

BACKGROUND OF THE INVENTION

The present invention relates to snow plows which mount on a motor vehicle, and more particularly to snow plows which are removably mounted on the rear of a motor vehicle and are carried off the ground when not in use.

The prior art is replete with motor vehicle mounted snow plows, some are even mounted on the rear of a motor vehicle. The generally accepted snow plow arrangement for use on highways and the like is the pusher type which mounts on the front of a vehicle. This type of snow plow can be set to push the snow off to the side of the highway and continue to move, thereby covering a large area in a short time. The problem with pusher type snow plows is that they are not effective in confined areas, such as driveways, where there is no room to get behind the snow. Front end mounted snow plows are usually backed up to a garage or end of a driveway which leaves an area the length of the vehicle unplowed.

Rear mounted snow plows which are pulled through the snow are suited for removing now close to a wall, garage or around a driveway. They are not well suited for highway snow removal. In general, rear mounted snow plows have a blade and side plates to scrape snow and trap it between the blade and the side plates.

The currently used snow plows are raised and lowered by a hydraulic or electric system which operates mechanical linkage between the plow and the motor vehicle. Older snow plow systems were strictly mechanical. Often raising and lowering mechanism is complex, requiring several lever arms and hydraulic cylinders. It would obviously be desirable to accomplish snow removal without the need for complex equipment.

The inventor is aware of several U.S. Patents on the subject of towed snow plows. There are patents which are directed to snow plows secured to the rear of a motor vehicle and which are attached by pins to the rear of a vehicle, these are U.S. Pat. Nos. 1,161,275, 3,483,641 and 4,506,465. These types of constructions differ from my construction where my rear plow is secured by a draw type hitch and is mounted with draw arms to ears fastened to the hitch. The advantage is that when the plow apparatus is removed the tow vehicle only has the basic hitch left on it permitting the tow vehicle and its hitch to be used to tow other apparatuses such as a horse trailer or a boat trailer and the like. This arrangement herein disclosed is very clear for by removing three pins the plow apparatus is removed in a few moments of time. Two front mounted snow plows are disclosed in U.S. Pat. Nos. 3,640,005 and 3,483,641. Of the above patents, only U.S. Pat. No. 3,640,005 discloses a linkage for raising or lowering a snow plow blade which is of interest regarding the present invention.

The present invention has a relatively simple method to raise and lower a rear mounted snow plow, as will be hereinafter described.

SUMMARY OF THE INVENTION

The present invention provides an apparatus for snow removal. Basically, the rear mounted snow plow is attached to a trailer hitch that is permanently affixed to the rear of the truck and includes a hydraulically operated mechanical linkage that is connected to the rear frame of a truck. The trailer hitch has a square hole in which the snow plow is connected. The linkage has an endmost pivotally mounted vertically extending arm that is adapted to be engaged at a lower end with a backside of the snow plow to assist in the raising and lowering of the snow plow as the hydraulic cylinder is operated. In addition, the snow plow has a pair of spaced stationary arms that project forwardly of an upright plow blade on opposite sides of the hydraulically powered linkage, and which diagonally extending upwardly inclined arms are pivotally connected to an underside of the frame of the hitch to stabilize the snow plow as the snow plow is raised and lowered by the hydraulically powered linkage.

The plow blade has a scraping edge welded to a vertically disposed blade body. A pair of end plates mounted on the blade trap plowed snow between the blade and end plate for removal. With the blade design and the hydraulically operated mechanical linkage it is possible to get within a half foot or less of a garage or end of a driveway.

It is an object of this invention to provide a snow plow for mounting on the rear of a motor vehicle, said plow having a hydraulically operated arm for raising and lowering of the blade.

A further object of this invention is to provide a snow plow for mounting on the rear of a motor vehicle, said plow having a simplified mechanical linkage for raising and lowering of the blade.

Still another object of this invention is to provide a snow plow blade capable of plowing close to stationary structures.

These and other objects will become apparent from the following drawings and description.

A snow plow apparatus for use with a motor vehicle by connecting the snow plow apparatus to the rear of a vehicle to plow snow close to a structure without striking the structure comprising:

a snow plow support assembly providing a three point connection for attachment to a rear of a vehicle and when detached leaving a rear of the vehicle free of any protrusions extending beyond peripheral boundaries of the vehicle, including a trailer hitch and a pair of spaced structural supports with pivot connections for supporting a snow plow apparatus;

a raising and lowering mechanism for raising a snow plow during travel and lowering a snow plow curing plowing operations, where the mechanism is removably mounted on the snow plow trailer hitch and support assembly;

a snow plow pivotally connected to the snow plow support assembly and to the raising and lowering mechanism where the snow plow is supported by the raising and lowering mechanism and the snow plow support assembly during travel and plowing operations;

the raising and lowering mechanism including a vertical stationary support with means for removably connecting to the trailer hitch, the means being permanently mounted near the lower end of the vertical stationary support, the vertical stationary support having an upper end pivot point and a lower end pivot point, a horizontal pivotal arm pivotally connected to the upper end pivot point of the vertical stationary support, a pivotal vertical support arm pivotally connected to the free end of the horizontal pivotal arm where the pivotal movement of the horizontal pivotal arm raises and lowers the pivotal vertical support arm;

a power source pivotally connected at one end to the lower end pivot point of the vertical stationary support and connected at the other end at or about the midpoint of the horizontal pivotal arm to pivotally raise and lower the free end of the horizontal pivotal arm;

a reinforced snow plow body having end plate means to trap plowed snow between the body and the end plate means, the reinforced snow plow body being connected to the pivotal vertical support arm at the lower free end of the pivotal vertical support arm, the snow plow body having a connector on the rear face of the body midway between the end plate means for connecting to the pivotal vertical support where raising the plow tilts the plow blade forwardly and where lowering the plow positions the plow blade vertically for the plowing operation; and a pair of stabilizing and pivoting arms connected to the front face of the plow blade at one end and pivotally connected to the snow plow support assembly structural supports pivot connection at the other end, the stabilizing and pivoting arms being spaced apart to provide stability and support to the plow blade during travel and plowing operations and to pull the plow blade during plowing operations where the snow plow blade is pulled by a vehicle to plow and capture snow in front of the blade body and between the end plate means, and the raising and lowering mechanism controls the raising and lowering of the blade body.

It is an important feature of my invention to provide a new and improved powered operated snow plow assembly that can be rear mounted at a rear of a self propelled towing vehicle by a three point quick connect-disconnect hitching assemblage that leaves the vehicle free of any attached super structure for connecting the snow plow assembly so that the vehicle will have an exterior configuration essentially the same as if the snow plow assembly was never associated with the self propelled vehicle.

DESCRIPTION OF THE INVENTION

Figure 1:
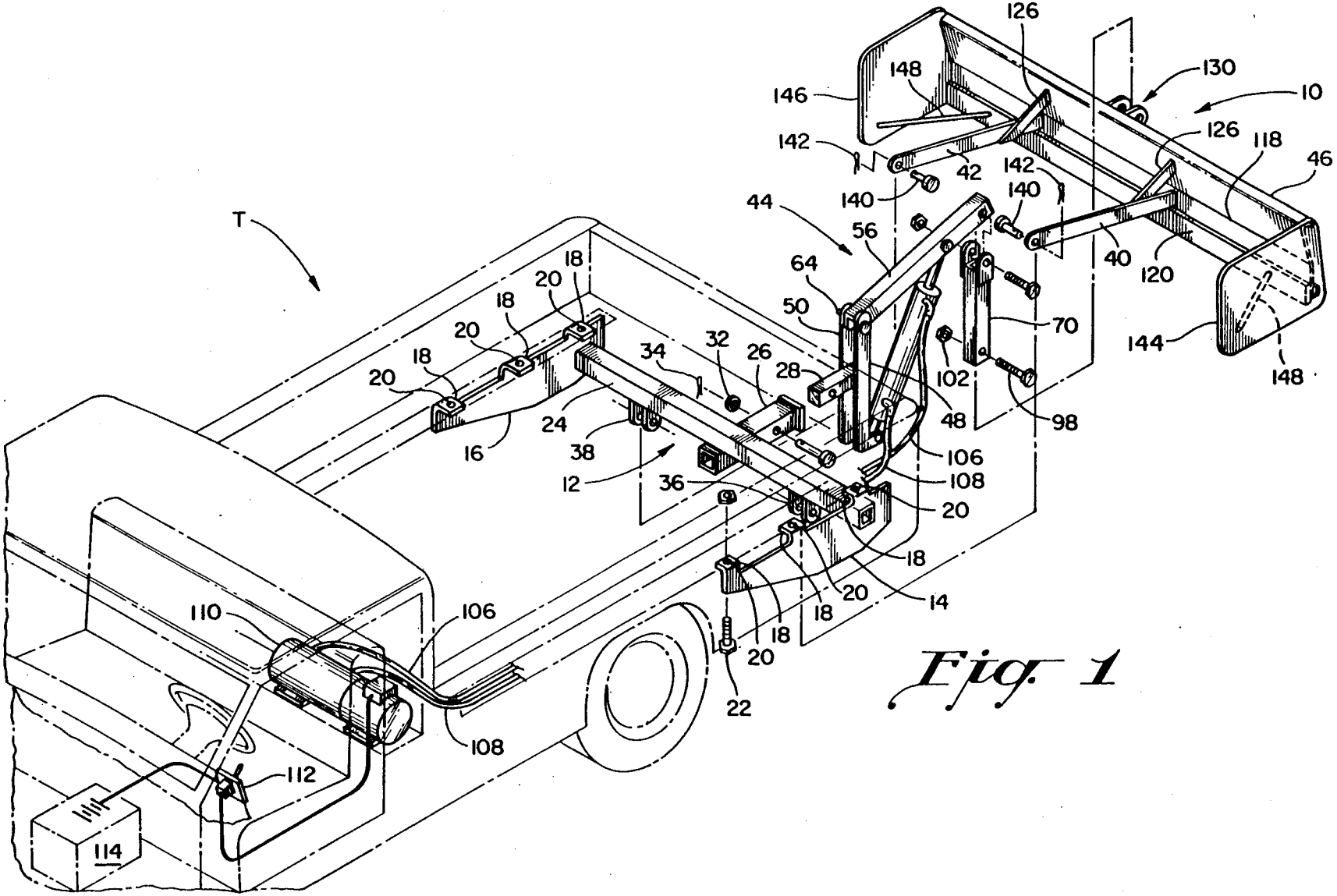
FIG. 1 is a perspective view of an illustrative embodiment of the invention.

Referring to the drawings FIGS. 1–5, there is shown a snow plow of the present invention. FIG. 1 shows how the snow plow apparatus 10 is mounted on the rear of a motor vehicle, a pickup truck being shown in this drawing. There is a permanently mounted Reese hitch 12 mounted under the truck body T. The hitch 12 includes a pair of body mounted support members 14 and 16. The support members 14 and 16, respectively have angled fastening members 18 with apertures 20 for receiving fasteners 22 that also pass through drilled apertures in the truck body T. The fasteners 22 can be of the conventional cap screw an nut type of easy removal, or they can be a permanent fastener, such as rivets. A box cross beam 24 is welded to the support members 14 and 16 to provide a stable weight and load bearing structure for the snow plow apparatus 10.

A Reese-type hitch coupling member 26 is welded midway of the cross beam 24. Coupling member 26 is the female portion of a Reese-type hitch for receiving the male portion 28 on the snow plow apparatus 10. The coupling member 26 may have a slightly enlarged opening to mate the coupling with the male member 28. A hitch pin 30, washer 32 and cotter pin 34 secure the coupling.

A pair of pivotal arm receiving connectors 36 and 38, respectively, are welded to the bottom side of the cross beam 24. The connectors 36 and 38, partially support stabilizing and pivoting arms 40 and 42, respectively, on the snow plow apparatus 10. A more detailed description of the stabilizing and pivoting arms 40 and 42 will be discussed when the plow blade is discussed Referring now to the raising and lifting mechanism 44, shown best in FIG. 4, there is shown an unassembled mechanism for attachment to a plow blade 46. The male coupling member 28 is welded between a pair of L-shaped arms 48 and 50, respectively, to support the weight of the raising and lifting mechanism 44 and snow plow 46. Each of the arms 48 and 50 has an upper end aperture 52 and a lower end aperture 54. The purposes of these apertures 52 will be explained. An upper pivotal arm 56 of a U-shaped construction with apertures 58, 60 and 62, respectively, is pivotally mounted to the upper end of the L-shaped arms 48 and 50. A cap screw 64, washer 66 and nut 68 secure the pivotal arm 56 to the L-shaped arms 48 and 50. A vertical pivot arm 70 with a U-shaped end 72 and apertures 74 in the U-shaped end 72 is pivotally connected to the upper pivotal arm 56 by cap screw 76, washer 78 and nut 80. The pivotal movement of the upper pivotal arm 56 and vertical pivot arm 70 will be explained in the operation of the mechanism 44. The lower end of the vertical pivot arm 70 has an aperture 82 for connecting to the snow plow blade 46.

A hydraulic double acting cylinder 84 with a fixed rod 86 which connects to aperture 54 in L-shaped arms 48 and 50 for pivotal movement. Cap screw 88, washer 90 and nut 92 support the hydraulic cylinder 84 on L-shaped arms 48 and 50. Rod 94 reciprocates in and out of cylinder 84 due to hydraulic pressure applied to one side or the other of a double faced piston, not shown. The rod 94 has an aperture 96 for connecting to pivot arm 56. A cap screw 98 washer 100, and nut 102 passes through aperture 96 in the rod 94 and aperture 68 which at or about midway of the arm in pivot arm 56. When hydraulic fluid applies pressure to one side of the piston, rod 96 either extends or retracts into the cylinder 84 which causes the pivot arm 56 to pivot about pivot cap screw 64, raising or lowering the other end 104 of the pivot arm 56. As pivot arm end 104 is raised or lowered, vertical pivot arm 70 is also moved, accordingly, about pivot cap screw 76.

The hydraulic system for raising and lowering the snow plow blade 46 is best shown in FIG. 1. There are hydraulic lines 106 and 108 connected to hydraulic cylinder 84 and to storage tank and pump combination 110. The pump is of the reversible type where pressure is applied to one or the other of the hydraulic lines 106 or 108. To control the direction in which the mechanism 44 moves, either to raise or lower, an electric control 112 is mounted on the dashboard of the truck and receives power from a battery 114.

Figure 5:
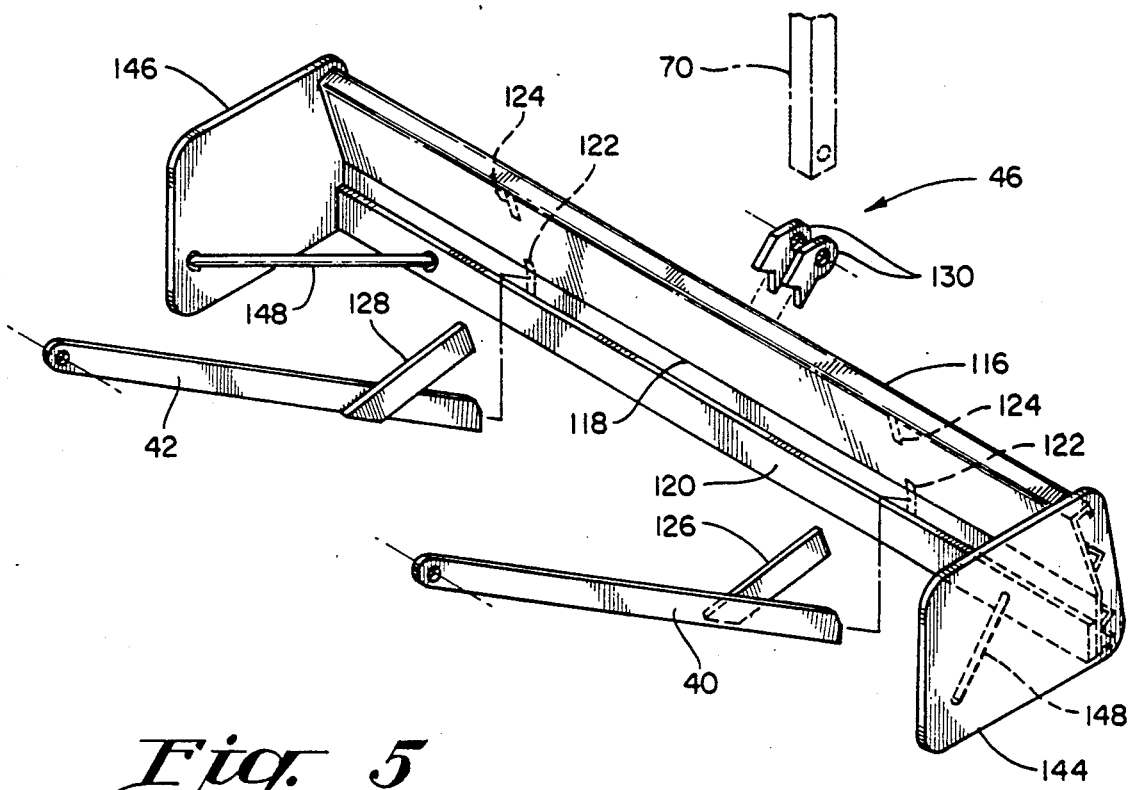
FIG. 5 is a perspective of a disassembled view of a snow plow blade of the invention.

Snow plow blade 46 has a reinforced vertical body 116 which has a curvature break at 118, as shown in FIG. 5, to push plowed snow forwardly of the blade. The lower edge of the blade body 116 has a scraper 120 that may either permanently or removably attach to the blade body 116. Each of the stabilizing and pivoting arms 40 and 42 are welded to the blade body 116 at two points 122 and 124. There are braces 126 and 128 welded to the arms 40 and 42, respectively. The braces 126 and 128 give added rigidity to snow plow blade 46 as it is pulled through snow and raised or lowered. As mentioned, the stabilizing and pivoting arms 40 and 42 are connected to connectors 36 and 38 on the Reese-type hitch cross member 24. When the mechanism 44 is raised or lowered, the vertical pivot arm 70, which is connected to the snow plow blade 46 at pivotal support coupling 130 by a cap screw 132, and inserted through apertures 138 in pivotal support coupling 130 and aperature 82 in vertical pivot arm 70 to receive washer 134 and nut 136, moves the snow plow blade 46 about pivot point hitch pins 140, held in place by cotter pins 142. The blade 46 is also provided with a pair of reinforcing angles 143' which extend the full length of the blade 46 and are welded to the blade 46.

A pair of end plates 144 and 146 are welded to the ends of the blade body 116 and reinforced by reinforcing bars or struts 148, welded to the end plates and to the scraper 120, as shown, or to the blade body 116 where the scraper is replaceable. The struts 148 are an optional feature. The end plates 144 and 146 trap plowed snow between the end plates and the blade body for clean and easy removal.

Figure 2:
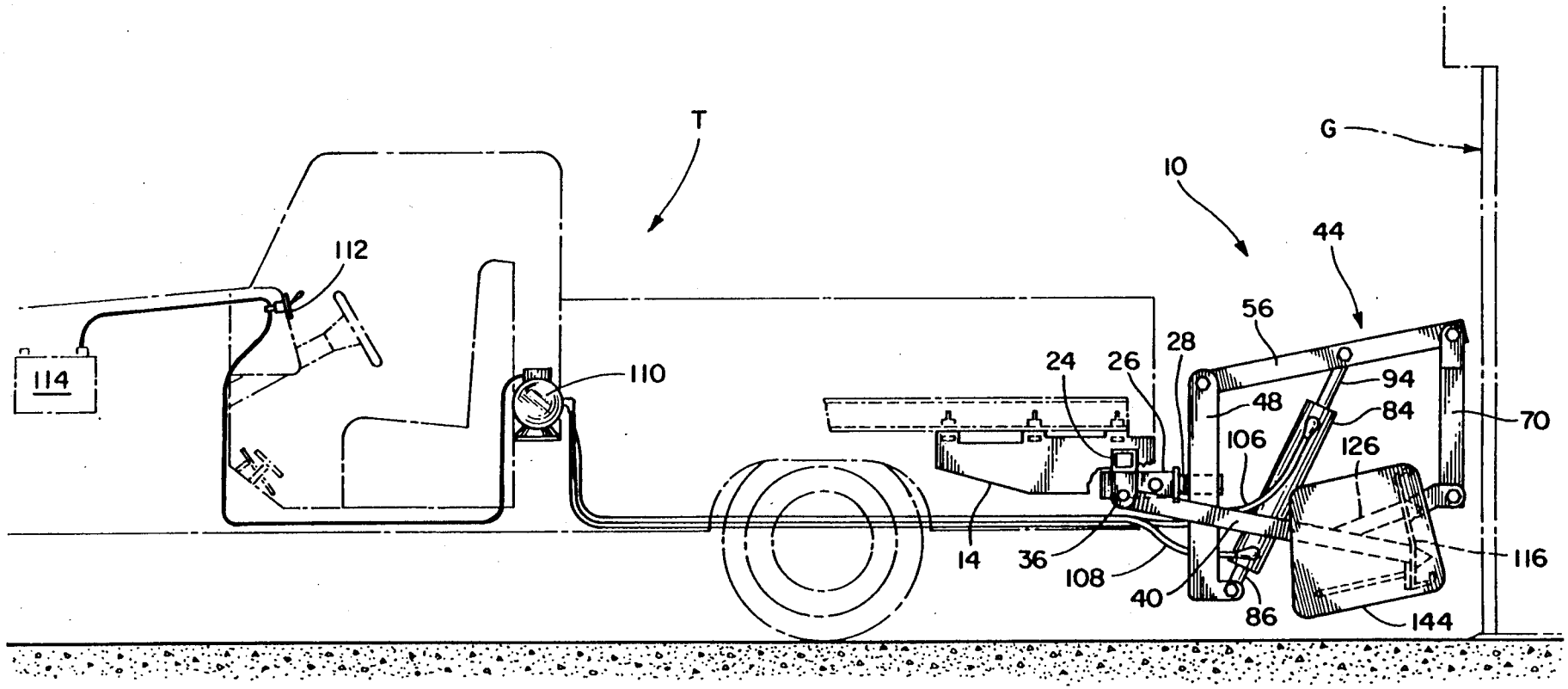
FIG. 2 is a side plan view of a snow plow of the invention mounted on a motor vehicle, with the snow plow in partially raised position.
Figure 3:
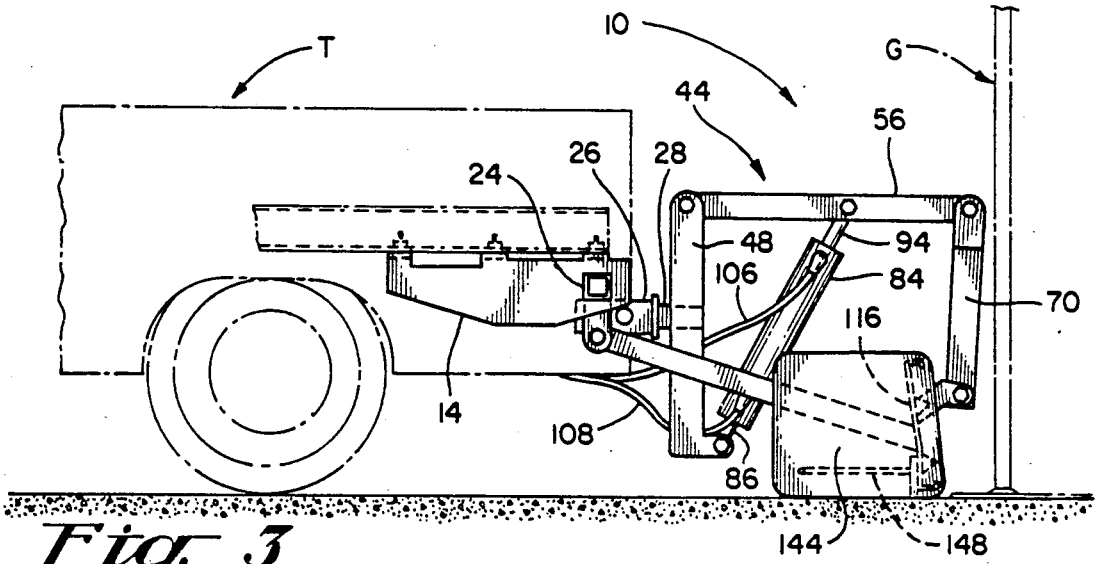
FIG. 3 is a side plan view of a snow plow of the invention shown mounted on a motor vehicle with the snow plow diagrammatically illustrated in a lowered position.
Figure 4:
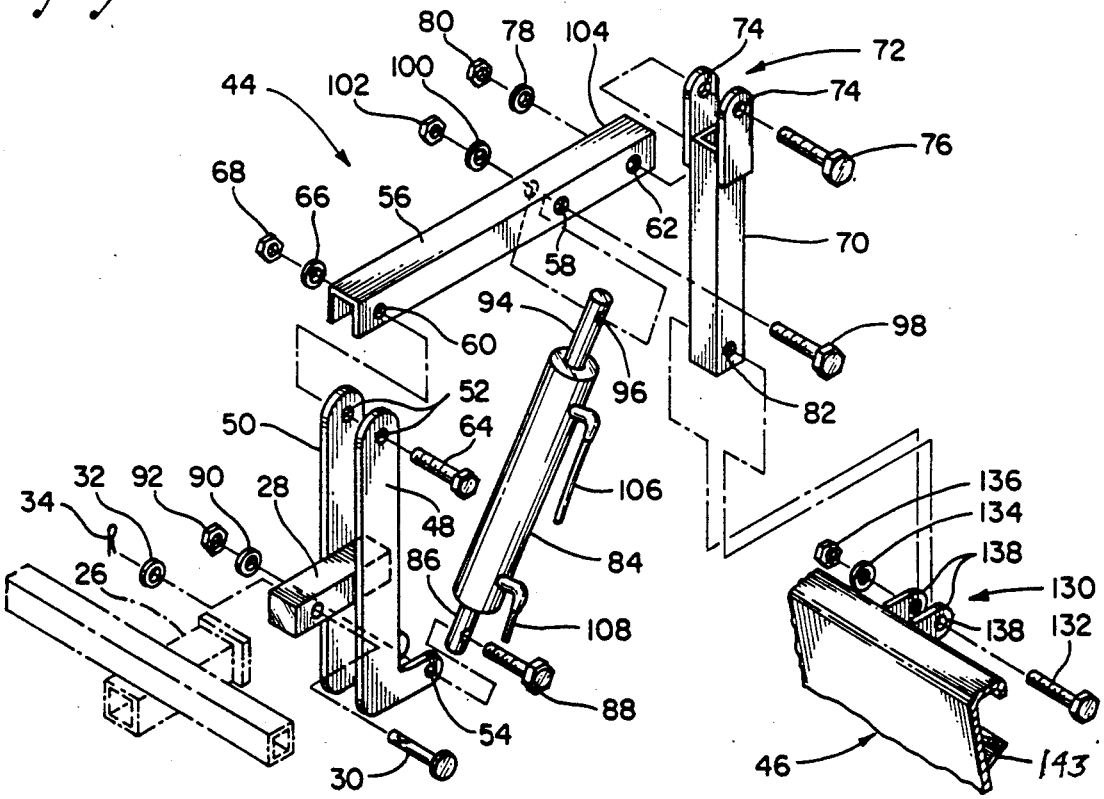
FIG. 4 is a perspective disassembled view of a hydraulically operated mechanically linkage of the invention.

FIGS. 2 and 3 best show the operation of the snow plow apparatus 10. The truck 10 is backed up to a garage G, within one foot of the structure. At this point the snow plow 46 is raised for travel. Hydraulic fluid has extended rod 94 out of cylinder 84, pushing the free end of pivot arm 56 upwardly. Vertical pivot arm 70 connected to pivot arm 56 raised snow plow 46, as shown. The stabilizing and pivoting arms 40 and 42, moved with the snow plow blade 46 while pivoting about pivot points 140 to stabilize and partially support the snow plow blade 46. The positioning of arms 40 and 42 on the blade body 116 is important to the stability of snow plow blade 46. The arms 40 and 42 are separated about the width of a truck body and are spaced equal distances from the ends of blade body, FIG. 5.

In FIG. 3 the snow plow 46 has been lowered to rest on the ground, without striking the garage G. The snow plow 46 was lowered by hydraulically retracting the rod 94 into cylinder 84. When the rod 94 is retracted, pivot arm 56 is pivoted downwardly, moving vertical pivot arm and snow plow 46 downwardly to the position of FIG. 3. Stabilizing and pivoting arms 40 and 42 are pivoted about pivot points 140. In the lowered position, the truck pulls the snow plow 46 forward to plow and remove snow. When the plow is in a fully lowered position, then the weight of the truck body bears on the plow to more effectively scrap snow and ice and the cylinder arm 94 will be fully engaged in the cylinder 84 which relationship is not fully shown in FIG. 3.

While my support assembly including the raising and lowering mechanism has been specifically illustrated for use in connection with a snow plow, it will be appreciated that other apparatuses might be substituted in place of the snow plow such as a towed brush assembly for sweeping streets and the like. Thus, it is contemplated that certain principles of my herein disclosed new and improved apparatus would be useable and applicable to towing other implements for performing other types of operations.

While only one embodiment of the invention has been disclosed, it is understood that one skilled in the art may realize other embodiments of the invention, therefore one should study the drawings, description and claims for a complete understanding of the invention.

I claim:

1. A snow plow apparatus for use with a motor vehicle by connecting the snow plow apparatus to the rear of a vehicle hitch to plow close to a structure without striking the structure, comprising;

a snow plow support means on a vehicle for stabilizing and supporting a snow plow means during travel and during plowing operations;

a raising and lowering mechanism for raising said snow plow means during travel and lowering said snow plow means during plowing, where said mechanisms is mounted on a vehicle;

said snow plow means connected to said snow plow support on a vehicle and to said raising and lowering mechanism connected to the same vehicle, where said snow plow means is supported by said raising and lowering mechanism and said support means during travel and during plowing operations;

said raising and lowering mechanism including a mechanical means operated by a hydraulically operated power means connected at one end to said snow plow support means at a first vertical support means, a second vertical support means pivotally connected to the other end of said pivotal arm means where the pivotal movement of said pivotal arm means raises said second vertical support as said pivotal arm means is raised and lowered as said pivotal arm means is lowered; a hydraulic cylinder connected at one end to the lower end of said first vertical support and the other end connected at or about the mid point of said pivotal arm means, for raising and lowering said pivotal arm means;

said snow plow means connected to said second vertical support means to respond to the raising and lowering said snow plow means, said snow plow means having a reinforced blade body with end plate means to trap plowed snow between said blade body and said end plate means, a pair of stabilizing and pivoting arm means affixed to said blade body at one end and pivotally connected to said snow plow support means on the vehicle at the other end where said pair of stabilizing and pivoting arms means partially support said snow plow means during travel, and pulls said snow plow means during plowing operations;

said second vertical arm means is pivotally connected to the rear of said blade body whereby as said snow plow means is raised said blade body is tilted forward to remove snow from said snow plow means, and whereas said snow plow means is lowered said blade body is tilted backward to capture snow to be plowed and;

where said snow plow means is pulled by a vehicle to plow and capture snow in front of said blade body and between said end plate means, and said raising and lowering mechanism controls the raising and lowering of said blade body.

2. A snow plow apparatus as defined in claim 1 wherein said blade body is curved forwardly to push plowed snow forward of said blade body.

3. A snow plow apparatus as defined in claim 2 wherein said snow plow apparatus is removably connected to said snow plow support means on said vehicle.

4. A snow plow apparatus as in claim 3 wherein said vehicle rear mounted snow plow means plows up close to stationary structures.

5. A snow plow apparatus for use with a motor vehicle by connecting the snow plow apparatus to the rear of a vehicle to plow snow close to a structure without striking the structure comprising:

a snow plow support assembly providing a three point connection for attachment to a rear of a vehicle and when detached leaving a rear of the vehicle free of any protusions extending beyond peripheral boundaries of the vehicle, including a trailer hitch and a pair of spaced structural supports with pivot connections for supporting a snow plow apparatus;

a raising and lowering mechanism for raising a snow plow during travel and lowering a snow plow during plowing operations, where said mechanism is removably mounted on said snow plow trailer hitch and support assembly;

a snow plow pivotally connected to said snow plow support assembly and to said raising and lowering mechanism where said snow plow is supported by said raising and lowering mechanism and said snow plow support assembly during travel and plowing operations;

said raising and lowering mechanism including a vertical stationary support with means for removably connecting to said trailer hitch, said means for removably connecting being permanently mounted near the lower end of said vertical stationary support, said vertical stationary support having an upper end pivot point and a lower end pivot point, a horizontal pivotal arm pivotally connected to said upper end pivot point of said vertical stationary support, a pivotal vertical support arm pivotally connected to the free end of said horizontal pivotal arm where the pivotal movement of said horizontal pivotal arm raises and lowers said pivotal vertical support arm;

a power source pivotally connected at one end to said lower end pivot point of said vertical stationary support and connected at the other end at or about the mid-point of said horizontal pivotal arm to pivotally raise and lower the free end of said horizontal pivotal arm;

a reinforced snow plow body having end plate means to trap plowed snow between said body and said end plate means, said reinforced snow plow body being connected to said pivotal vertical support arm at the lower free end of said pivotal vertical support arm, said snow plow body having a connector on the rear face of said body midway between said end plate means for connecting to said pivotal vertical support where raising said plow tilts said plow blade forwardly and where lowering said plow positions said plow blade vertically for the plowing operation; and a pair of stabilizing and pivoting arms connected to the front face of said plow blade at one end and pivotally connected to said snow plow support assembly structural supports pivot connection at the other end, said stabilizing and pivoting arms being spaced apart to provide stability and support to said plow blade during travel and plowing operations and to pull said plow blade during plowing operations where said snow plow blade is pulled by a vehicle to plow and capture snow in front of said blade body and between said end plate means, and said raising and lowering mechanism controls the raising and lowering of said blade body.

6. A snow plow apparatus as defined in claim 5 wherein said power source is a hydraulically operated cylinder.

7. A snow plow apparatus as defined in claim 5 wherein said blade body is curved forwardly to push plowed snow forward of said blade body.

8. A snow plow apparatus as defined in claim 7 wherein said vehicle rear mounted snow plow means plows up close to stationary structures.

9. A towed apparatus for use with a motor vehicle by connecting the towed apparatus to the rear of a vehicle comprising:

a support assembly providing a three point connection for attachment to a rear of a vehicle and when detached leaving a rear of the vehicles free of any protusions extending beyond peripheral boundaries of the vehicle, including a snow plow trailer hitch and a pair of spaced structural supports with pivot connections for supporting the towed apparatus;

a raising and lowering mechanism for raising a towed implement during travel and lowering a towed implement during working operations, where said mechanism is removably mounted on said snow plow trailer hitch and support assembly;

a towed implement pivotally connected to said support assembly and to said raising and lowering mechanism where said towed implement is supported by said raising and lowering mechanism and said support assembly curing travel and working operations;

said raising and lowering mechanism including a vertical stationary support with means for removably connecting to said trailer hitch, said means being permanently mounted near the lower end of said vertical stationary support, said vertical stationary support having an upper end pivot point and a lower end pivot point, a horizontal pivotal arm pivotally connected to said upper end pivot point of said vertical stationary support, a pivotal vertical support arm pivotally connected to the free end of said horizontal pivotal arm where the pivotal movement of said horizontal pivotal arm raises and lowers said pivotal vertical support arm;

a power source pivotally connected at one end to said lower end pivot point of said vertical stationary support and connected at the other end at or about the mid-point of said horizontal pivotal arm to pivotally raise and lower the free end of said horizontal pivotal arm;

a reinforced body having end plate means between said body and said end plate means, said reinforced body being connected to said pivotal vertical support arm at the lower free end of said pivotal vertical support arm, said body having a connector means on the rear face of said body midway between said end plate means for connecting to said pivotal vertical support where raising and lowering said towed implement for the working operation; and a pair of stabilizing and pivoting arms connected to a front face of said towed implement at one end and pivotally connected to said support assembly structural supports pivot connection at the other end, said stabilizing and pivoting arms being spaced apart to provide stability and support to said towed implement during travel and working operations and to pull said towed implement during working operations, and said raising and lowering mechanism controls the raising and lowering of said towed implement.

* * * * *